United States Patent [19]

Scheib et al.

[11] 4,028,923

[45] June 14, 1977

[54] PLUG AND SHOE CHANGING IN PIERCING AND REELING MILLS

[75] Inventors: William R. Scheib, Sewickley; James W. Schuetz, Pittsburgh, both of Pa.

[73] Assignee: Aetna-Standard Engineering Company, Ellwood City, Pa.

[22] Filed: May 4, 1976

[21] Appl. No.: 682,964

[52] U.S. Cl. ..... 72/97; 72/209; 72/238

[51] Int. Cl.[2] ..... B21B 19/06

[58] Field of Search ..... 72/95, 97, 209, 238, 72/248

[56] References Cited

UNITED STATES PATENTS

| | | | |
|---|---|---|---|
| 2,141,130 | 12/1938 | Findlater | 72/97 |
| 2,141,131 | 12/1938 | Findlater | 72/97 |
| 3,762,201 | 10/1973 | Schonfeld et al. | 72/209 |
| 3,924,435 | 12/1975 | Franceschina et al. | 72/209 |
| 3,927,547 | 12/1975 | Schonfeld et al. | 72/97 |
| 3,955,392 | 5/1976 | Prevot | 72/209 |

*Primary Examiner*—Lowell A. Larson
*Attorney, Agent, or Firm*—Mandeville and Schweitzer

[57] ABSTRACT

The disclosure is directed to improvement in piercing and reeling mills, to facilitate the changing of mandrel plugs and mill shoes. In piercing and reeling operations, mandrel plugs are supported at the ends of elongated mandrel bars, and workpieces are driven over the mandrel plugs while being rotated, to effect piercing and enlarging, in the case of piercing mills, and to achieve roundness, in the case of reeling mills. In each case, after processing a finite length of tubing, and while the workpiece remains on the mandrel, the mandrel is retracted, first stripping off the just-used mandrel plug, and then withdrawing the mandrel from the processed workpiece. A multi-position magazine is provided for retaining a circulating supply of mandrel plugs such that, after each operation, the used mandrel plug may be returned to the magazine for cooling, and a new plug may be brought quickly into working position ready for the next operation. The arrangement of the invention provides for expedited loading and discharge of the mandrel plugs, for greater efficiency in mill operation.

The invention is further directed to improvements in mechanisms for changing of mill shoes and mill shoe adapters, as is necessary from time to time in conjunction with changing of the size of the workpiece processed. The improved arrangement permits an upper mill shoe to be released and supported on the lower mill shoe, and includes provisions for horizontal transfer of the lower shoe, along with the released upper shoe, to a position clear of the mill rolls, where they are easily accessible to an overhead mill hoist. Provision additionally is made to facilitate and expedite the removal from the top of the mill of the entire mounting chair for the upper mill shoe and its adapter, to facilitate change of the adapter and chair for different sizes of workpieces.

23 Claims, 23 Drawing Figures

19
21
160
161
162
164
165
166
167
168
171
172
174
175
176
177
178
181
182
183
184
185
186
187
188
189
190
191
192
193
194
196
197
198
199
200
201
202
203
204

PLUG AND SHOE CHANGING IN PIERCING AND REELING MILLS

BACKGROUND AND SUMMARY OF INVENTION

In the production of seamless tubing, it is conventional for a heated, cylindrical workpiece to be simultaneously rotated and driven over a piercing mandrel to form a tube. The pierced, tubular workpiece may then be directed to a plug mill, for enlarging of diameter and reduction of wall thickness, and then further directed to a reeling operation where the workpiece is rapidly rotated and passed over a mandrel to improve roundness. In all of the before described operations, of piercing, sizing in the plug mill, and reeling, the workpiece is driven over a mandrel which carries at its upstream end a mandrel plug of appropriate size and shape. In each instance, after passage of a workpiece over the mandrel, the mandrel plug is removed from the mill for cooling and is replaced by a fresh plug. Efficient and advantageous arrangements for expediting the change of mandrel plugs in a plug mill are described and claimed in the related, copending application of Russell Jones, entitled "Plug Changer for Plug Mill" Ser. No. 682,920, filed May 4, 1976. The present invention is directed more particularly to techniques for the changing of the mandrel plugs in piercing and reeling mills.

In accordance with one aspect of the invention, a magazine, for retaining a circulating inventory of mandrel plugs, is movably mounted on the downstream side of the mill rolls. The magazine has a plurality of pockets for retaining mandrel plugs, and has a working position located generally directly below the pass line of the mill and at an upwardly inclined angle intersecting the pass line slightly downstream of the working bite of the mill rolls. Fresh mandrel plugs are successively brought into the working position, from which they are advanced along an upwardly inclined transfer chute, by means of a plug pusher ram. A portion of the transfer chute may be mounted for pivoted movement such that, when a fresh mandrel plug is positioned on the pivoting section, it may be swung upward into the pass line of the mill to facilitate joining of the mandrel plug and the mandrel. In other cases, the upper section of the transfer chute may be so contoured as to enable the mandrel plug, as it is elevated along the transfer chute by the pusher mechanism, to be properly aligned with the pass line axis of the mill.

In piercing and reeling mills, the working rolls of the mill are mounted in a horizontally opposed arrangement, and the workpiece is supported between the rolls by means of longitudinally grooved mill shoes, which confine the workpiece vertically while permitting it to rotate and advance longitudinally. These mill shoes are subject to substantial wear and must be replaced with relative frequency. Accordingly, it is an additional aspect of the invention to provide a novel arrangement for mounting and securing mill shoes in a piercing or reeling mill, such that the down time involved in effecting a change of mill shoes may be significantly reduced as compared to conventional means. More particularly, the upper mill shoe is secured by a releasable clamp, which enables the shoe to drop down onto the lower shoe (or onto to a filler block inserted between the shoes). The lower mill shoe is mounted on a horizontal slide mechanism, and this mechanism is actuated after the upper shoe has been released and serves to simultaneously unclamp the lower shoe and to physically deliver the unclamped upper and lower shoes to an accessible position on the downstream side of the mill rolls. The mill shoes are thus easily accessible to an overhead hoist or crane, for easy removal and replacement. After new shoes have been put into position, the horizontal slide mechanism is retracted back into the area of the mill bite, which not only carries the mill shoes back into the working area but locks the lower shoe and its adapter into position, automatically, when the mechanism reaches its working position. The upper mill shoe is then engaged and locked into position by its clamping mechanism, after which the mill is again ready for operation.

As a further feature of the invention, provision is made for simplifying and expediting the complete removal from the mill of the so-called chair assembly which adjustably supports the upper mill shoe and its adapter, in order to facilitate change of mill shoes and mill shoe adapters for accommodation of a new size of tubing in the mill. To this end, the chair assembly for the upper mill shoe is adjusted and locked into position by a combination of upwardly acting fluid cylinders and downwardly acting screw-downs. To effect complete release of the chair assembly, the hydraulic cylinders are retracted slightly, and the downwardly acting screw-downs, advantageously in the form of Tee-headed bolts, are manipulated to a release orientation, enabling the upper chair and its support to be bodily removed from the mill. After change of the mill shoe adapter and/or of the upper chair itself, if necessary, the entire assembly is reinserted into the mill cap, the Tee-headed screw-down bolts are turned to a locking orientation, and the assembly is locked back into position by energizing of the upwardly acting cylinders. An important practical advantage of this arrangement is that the upwardly acting fluid cylinders, in continuously urging the mill cap upward against the T-headed screw downs, eliminate backlash in the hold-down system.

All the various features of the invention are designed to expedite the non-productive aspects of mill operation, particularly change of mandrel plugs and change of mill shoes and adapters, such that the mill can be maintained in production operation during a maximum percentage of its working time. Because of the extremely high capital costs of such mills, it will be readily understood that important advantages can be achieved by increasing the actual production output of a given mill through reduction of down time.

For a more complete understanding of the above and other features and advantages of the invention, reference shoud be made to the following detailed description of certain preferred embodiments of the invention, and to the accompanying drawings.

DESCRIPTION OF PREFERRED EMBODIMENTS

Figure 1:
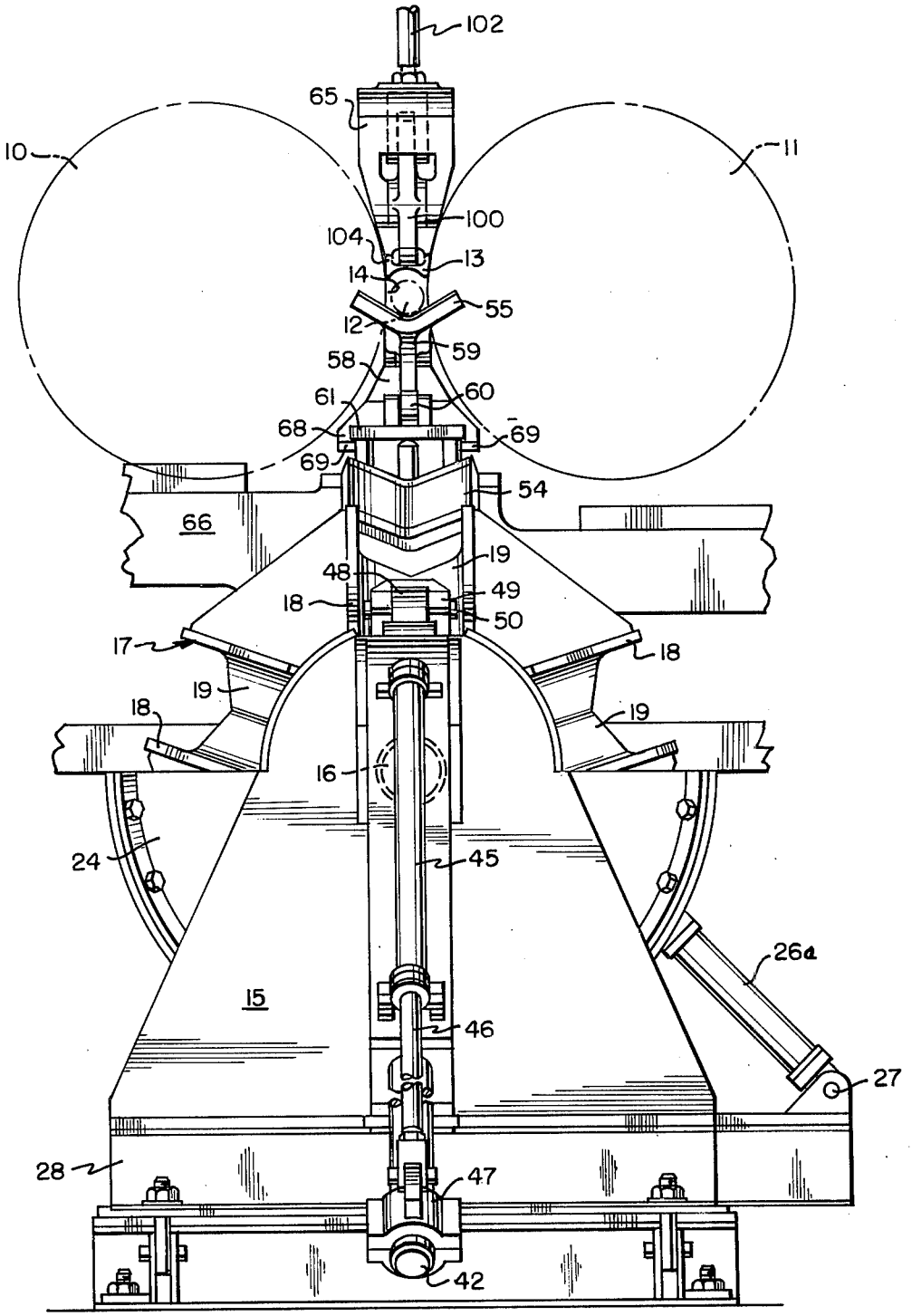
FIG. 1 is a fragmentary end elevational view of a plug changer installation according to the invention, as incorporated in a typical piercing mill.
Figures 2, 7:
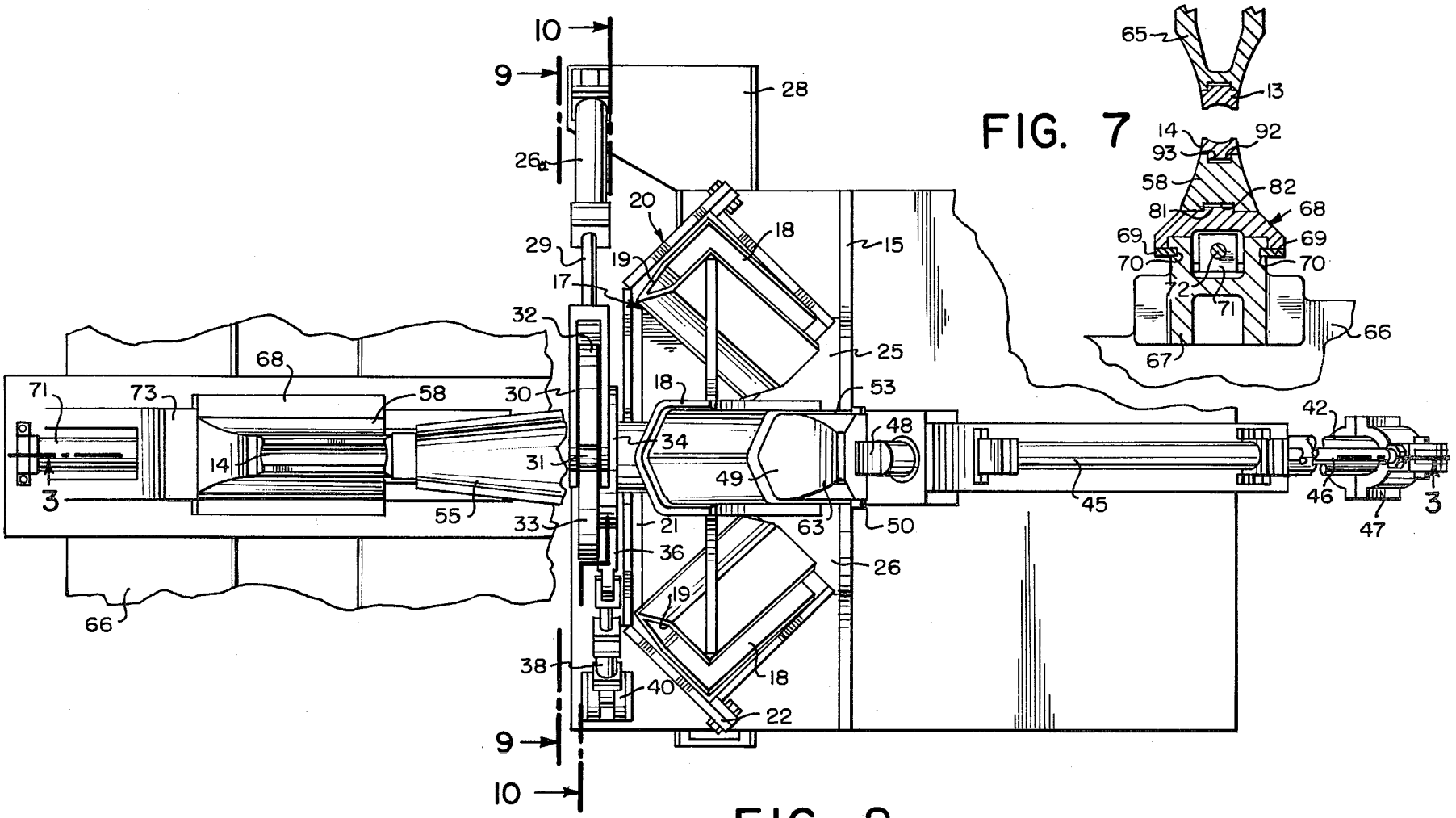
FIG. 2 is a top plan view of the plug changer of FIG. 1, with parts broken away to illustrate certain details.
FIG. 7 is a cross sectional view as taken generally on line 7—7 of FIG. 3.

Referring now to the drawings, and initially to FIGS. 1–12 thereof, the reference numeral 10, 11 represents generally the working rolls of a piercing mill which, in its generalities, may be of known construction. In FIG. 1, the mill is viewed from the downstream side of the mill rolls. According to known practice, the mill rolls 10, 11 are horizontally opposed and arranged with their axes on a slight angle relative to the horizontal, so as to impart a helical rolling action to a cylindrical workpiece. A conventional piercing mill includes an elongated mandrel (not shown) anchored at its downstream end by a movable thrust block carriage (not shown) which is arranged to position the upstream of the mandrel near the working bite of the mill rolls. The mandrel supports, at its upstream end, a tapered piercing plug 12. The piercing plug 12, in accordance with known procedure, is arranged to be positioned with its tip substantially at the roll bite, midway between upper and lower shoes 13, 14. When a heated, cylindrical workpiece is sent into the piercing mill, it is guided and confined by the mill shoes 13, 14, which are longitudinally grooved to conform closely to the outer contours of the workpiece. As the workpiece enters the roll bite, it is gripped by the piercing mill rolls and advanced helically over the piercing point 12, which is initially held in alignment with the central axis of the workpiece by supporting means (not shown).

The action of the angularly disposed working rolls 10, 11 serves to advance the workpiece helically over the piercing point, until the workpiece has been pierced over its full length, and has been advanced to a position downstream of the mandrel plug 12. Then, in accordance with known practice, the thrust block carriage is retracted in a downstream direction, along with the mandrel, serving at the outset to strip off the mandrel plug 12 and upon continued downstream retracting movement to withdraw the entire mandrel from within the pierced workpiece. As soon as the mandrel is free, the workpiece is discharged laterally from the outlet tables, on which it is then supported, and the thrust block returns the mandrel back toward the working rolls for a subsequent piercing operation. In the meantime, according to the invention, provisions are made for removing the just-used mandrel plug 12 for cooling, and replacing it with a fresh plug.

In the piercing mill apparatus of FIGS. 1–13, the plug changer mechanism includes a supporting frame 15, which is mounted on the downstream or discharge side of the roll bite, and rotatably journals a shaft 16 carrying a conical plug-holding drum 17. The drum 17 has a plurality (five in the illustration) of plug-receiving pockets 18 therein. In the illustrated arrangement, the supporting shaft 16 is mounted on a generally horizontal axis, and the plug-receiving pockets 18 are disposed at a substantial angle (e.g., 45°) to the rotational axis. The uppermost pocket forms the working position, from which new mandrel plugs are ejected and into which used mandrel plugs are received. Desirably, this working position is located substantially directly underneath the pass line of the mill, disposed along an axis directed upwardly and rearwardly at about 45°. Each of the plug pockets is provided with a V-shaped bottom 19, which functions to centrally locate a mandrel plug in the uppermost or working pocket.

Figures 3, 5, 11:
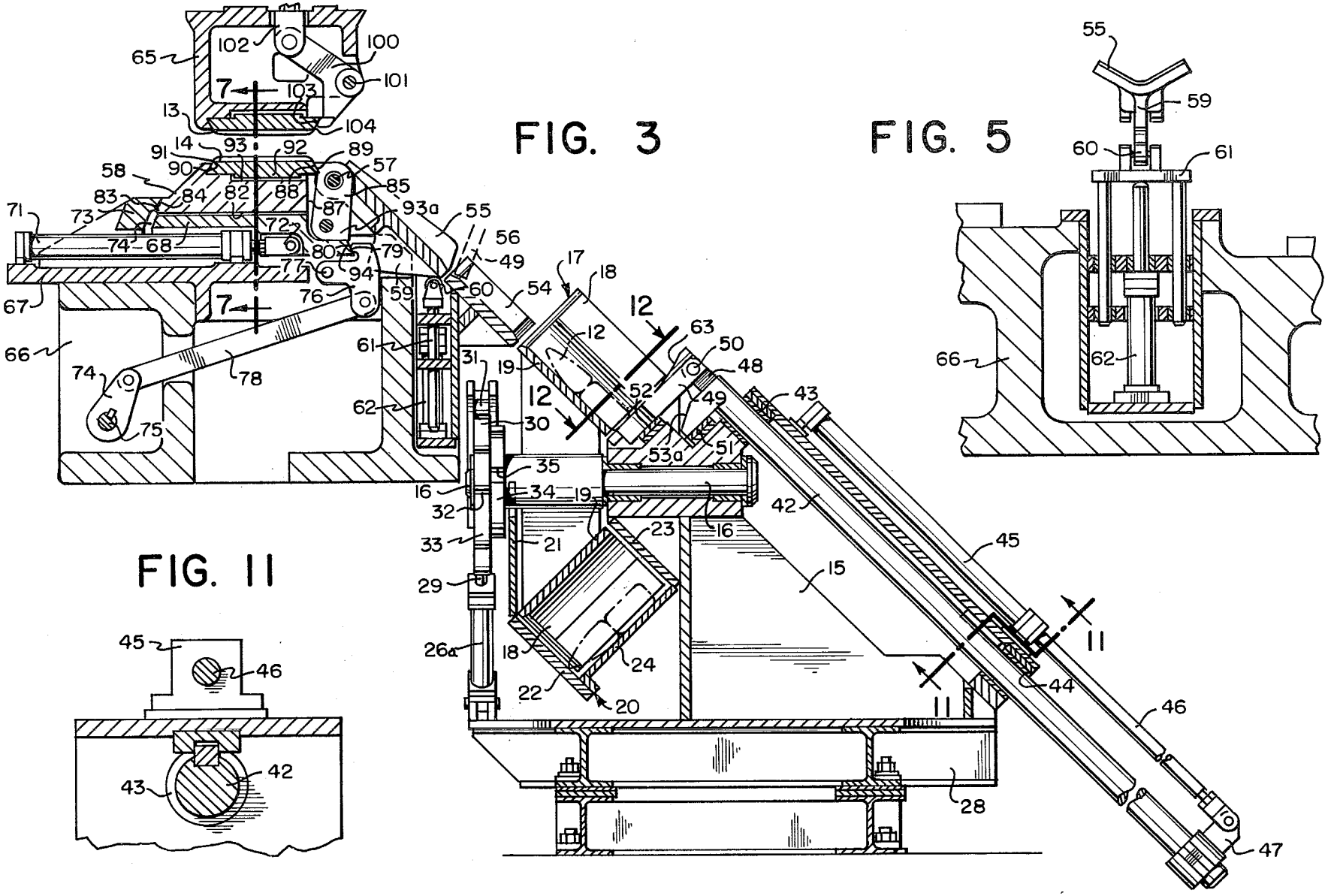
FIG. 3 is a cross sectional view as taken generally on line 3—3 of FIG. 2.
FIGS. 5 and 6 are cross sectional views as taken generally on lines 5—5, 6—6 respectively of FIG. 4.
FIGS. 11 and 12 are cross sectional views as taken generally on lines 11—11, 12—12 respectively of FIG. 3.
Figure 9:
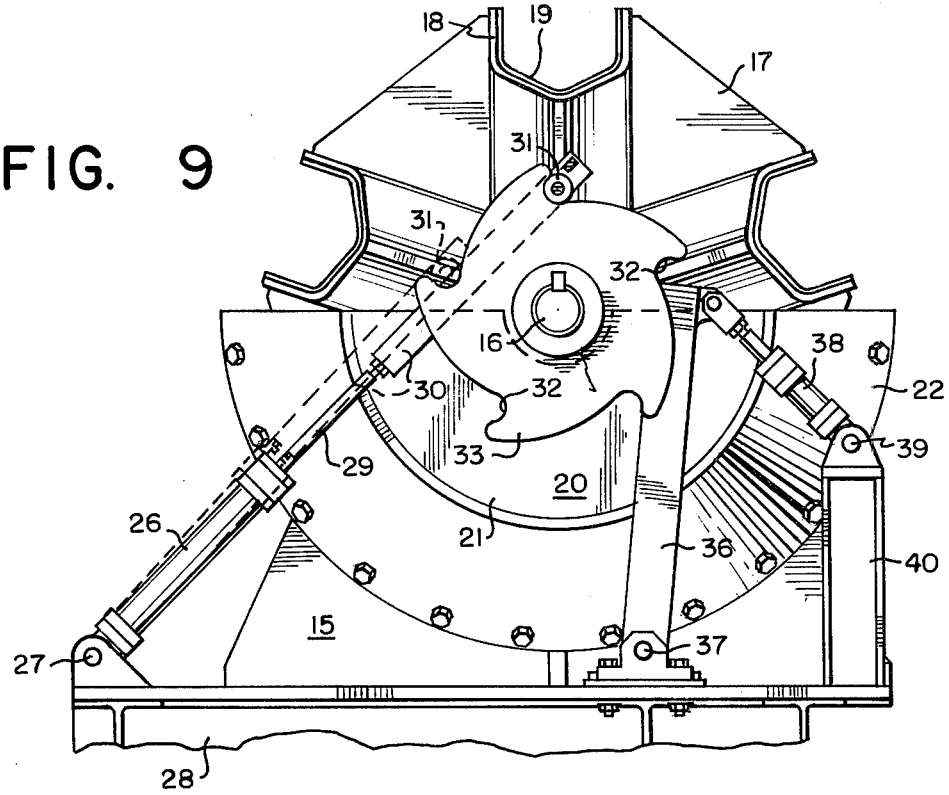
FIGS. 9 and 10 are cross sectional views as taken generally along lines 9—9, 10—10 respectively of FIG. 2.

As reflected particularly in FIGS. 1, 3 and 9, the plug retaining drum 17 is contained within a housing 20, comprising upper and lower front walls 21, 22 and upper and lower back walls 23, 24 all suitably secured to the supporting frame 15. The housing 20 is generally watertight and is arranged to retain a bath of cooling water for cooling of the used mandrel plugs. The lower walls 22, 24, and also the upper back wall 23 of the housing are located closely adjacent to the open ends and the open outer sides of the plug pockets 18 and serve to effectively enclose the open sides of the pockets as they traverse through the housing. Additionally, there are conical back wall extensions 25, 26 (FIG. 2), forming continuations of the lower back wall section 23 and serving to close the open lower ends of the plug pockets 18, as they traverse the upper half of their rotational pass.

Figure 10:
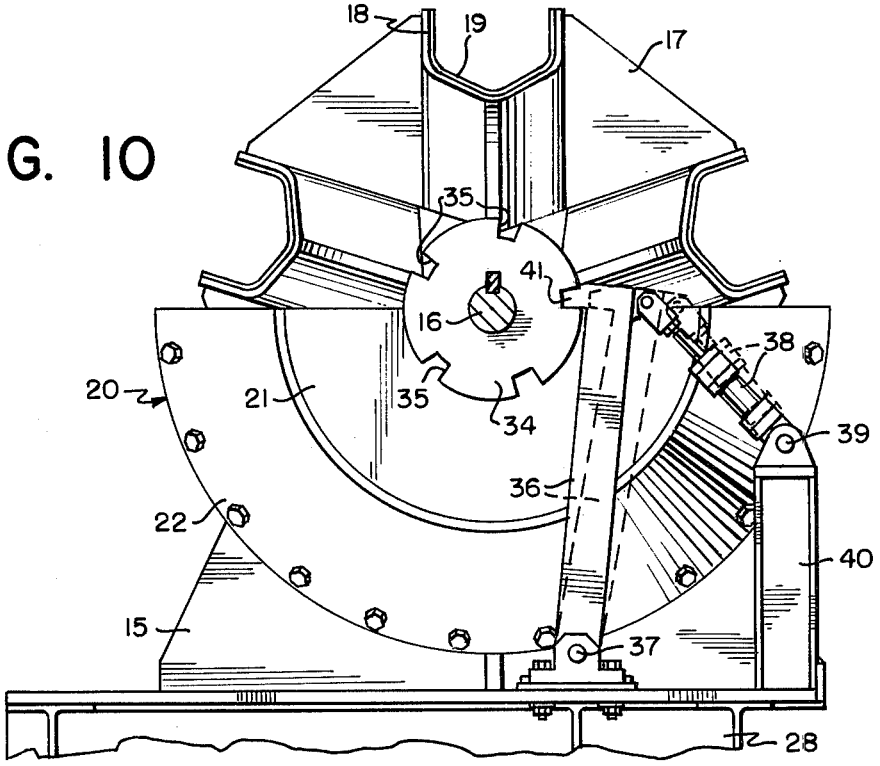

Controlled rotation of the plug retaining drum 17 is provided by means of a ratchet drive mechanism (FIG. 9) and locking mechanism (FIG. 10). The drive mechanism includes a fluid actuator 26*a* pivoted at 27 to the foundation frame 28 and having its operating rod 29 secured to a divided bracket 30 mounting a roller 31 at its outer end. The roller 31 is engageable with any of a series of drive pockets 32 in a drive wheel 33, which is keyed to the drum mounting shaft 16. Each of the drive pockets 32 corresponds to one of the plug-receiving pockets 18 of the drum. A locking wheel 34 is also keyed to the shaft 16 and is provided with a plurality of locking notches 35 corresponding to the number of plug pockets 18 and drive pockets 32. A latching pawl 36 is pivoted at 37 on the foundation frame 28 and is operated by a hydraulic actuator 38 pivoted at 39 on a frame post 40. When the latching pawl 36 is pivoted to the left, as shown in FIG. 10, a latching finger 41 enters one of the recesses 35 to lock the drum in a predetermined rotational orientation. In order to advance the drum to a new position, the latching pawl 36 is first withdrawn, and the drive cylinder 26*a* is actuated to retract, rotating the drum through one step (one fifth revolution). At the end of the rotational step, the latching pawl 36 is driven into the next successive latching pocket 35 to lock the drum in its new orientation.

A new mandrel plug 12 is delivered from the holding drum 17 by means of a pusher ram 42, guided in slide bearings 43, 44 on the frame 15 and actuated by an elongated hydraulic cylinder 45. The operating rod 46 of the actuator 45 is secured by a clamping bracket 47 to the lower end of the ram 42, such that the ram is moved upwardly by retracting movement of the actuator rod 46.

At the upper end of the ram 42 is a pusher head 48 which carries an abutment plate 49, pivoted at 50. In the retracted position of the ram 42, the pusher head 48 bottoms against a stop pad 51, and the free swinging lower end of the abutment plate 49 bottoms against an abutment pad 52. The arrangement is such that the abutment plate 49 is substantially flush with and forms in effect a continuation of the upper housing walls 25, 26, there being a suitable gap 53 between said walls (FIG. 2) to acccommodate the presence of the abutment plate. Thus, as new mandrel plugs 12 are successively brought into the working position by incremental rotation of the drum 17, the lower end of the plug in the working position will be supported by the abutment plate 49 which, in that position, constitutes the back wall of the plug pocket 18.

In order to feed a new mandrel plug 12 from the working pocket of the drum 17, the actuator 45 is energized by admission of fluid to its rod end. As soon as the ram 42 commences its upward movement, the abutment plate 49 pivots by the action of gravity downward, until it engages an abutment surface 53. After engaging the abutment surface 53*a*, the plate 49 begins to push the mandrel 12 up the inclined surface, out of its pocket 18 and onto an intermediate, V-shaped supporting trough 54. Continued upward movement of the ram 42 causes the mandrel plug 12 eventually to be pushed onto a transfer trough 55, which is likewise of V-shaped section corresponding generally to the contours of the bottom of the plug pocket 18 and the intermediate supporting trough 54.

At the position of maximum extension of the ram 42, the abutment plate 49 lies just below the lower end 56 of the transfer trough, as indicated in broken lines in FIG. 3.

Figures 4, 6, 12:
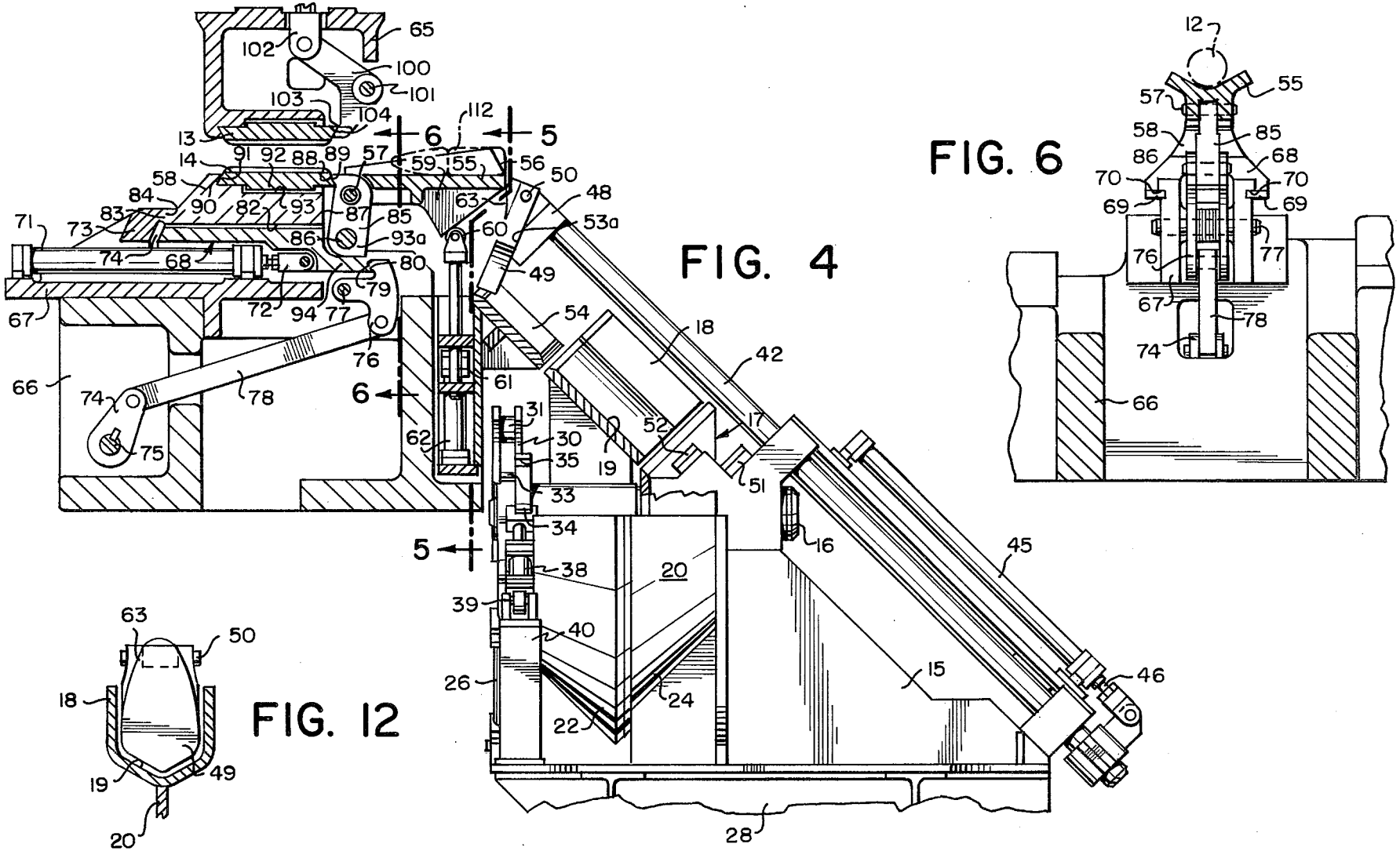
FIG. 4 is a cross sectional view, similar to FIG. 3, showing the plug changer mechanism in a condition after having delivered a mandrel plug to the pass line of the mill.

To advantage, the transfer trough 55 is pivoted at its upper end by a pin 57 secured to an adapter block 58 for the lower mill shoe 14. With the mill shoe and its adapter 58 in their normal working positions, the transfer trough 55 has a normal or loading position angled downwardly, substantially in alignment with the intermediate trough 54 and the working position plug pocket 18. The pivoted transfer trough is supported in this position by means of a lifting cam 59*a* engaged by a cam follower wheel 60 carried by a slide bracket 61 (FIG. 5) and operated by a lifting cylinder 62. When a new mandrel plug has been pushed upward by the ram, to the full extension of the ram, the lifting cylinder 62 is then actuated to raise the transfer trough 55 into its horizontal or transfer position, as shown in FIG. 4. During the upward pivoting movement, the backwardly tilted front face of the abutment plate 49 serves to guide the back of the mandrel plug. In addition, the upper portions of the abutment plate 49 may be provided with an outwardly curved guide surface 63, substantially conforming to the arc of curvature of the free end of the transfer trough, to limit the downward sliding of the new mandrel plug as the transfer trough is lifted.

With the plug 12 raised to the transfer position, as shown in FIG. 4, the plug is in position to be picked up by a mandrel being returned to the working position by the thrust block carriage. The facilities and controls for this purpose are well known and form no part of the present invention.

During the working phase of the mill, that is while a workpiece is being driven over the piercing plug 12, the transfer trough 55 is retracted, by retraction of the lifting cylinder 62, back to the original or loading position as shown in FIG. 3. The plug holding drum 17 remains statonary during this phase. When the piercing operation has been completed, and the pierced workpiece has been driven over and beyond the plug, the mandrel is withdrawn in a downstream direction, stripping off the mandrel plug and causing it to drop by gravity onto the now inclined transfer trough 55. The plug then drops by gravity back into the empty drum pocket, bottoming against the front face of the now-retracted abutment plate 49. The drum is then indexed to the next successive drum pocket and a new cycle is commenced.

With the described mechanism, the change of mandrel plugs, from the stripping of the just-used plug to the placement of a new plug in the waiting position, as shown in FIG. 4, is easily accomplished within the time period available during the withdrawal of the mandrel from the pierced workpiece, its discharge off of the run out table, and the return of the mandrel to working position.

In the piercing mill arrangement illustrated in FIGS. 1–13, provision is made for the expeditious removal and replacement of the mill shoes 13, 14 and their respective adapters 65, 58. In particular, since the mill shoes 13, 14 are intended to be wearable, replaceable elements, quick replacement thereof when necessary to significant to high efficiency operation of the mill. Changing of the adapters from time to time is also necessary to accommodate workpieces of different sizes.

Pursuant to the invention, the lower mill frame 66 (FIGS. 3, 4, and 6–8) mounts a fixed chair bracket 67, on which is mounted a sliding chair bracket 68, the sliding bracket being engaged with the fixed bracket by means of flange strips 69 received in corresponding longitudinally disposed slots 70 in the fixed bracket. A hydraulic actuator 71 has its cylinder portion secured to the fixed chair bracket 67, and its rod portion 72 is secured to the sliding chair bracket 68. When the actuator 71 is retracted, the sliding chair bracket 68 is arranged to approach but not engage a cross bar 73 of the fixed lower chair bracket, providing a slight clearance 74 between the fixed sliding brackets. Desirably, mechanical means are provided for locking the sliding lower chair bracket 68 in its retracted position, to provide against possible failure in the hydraulic system. This mechanical system may be in the form of a crank arm 74 keyed to and carried by a locking shaft 75. A locking lever 76 is pivoted at 77 on the fixed chair bracket and is connected by a line 78 to the crank arm 74. When the crank arm 74 is rotated in a clockwise direction, as viewed in FIG. 4, the locking lever 76 is rotated counterclockwise, bringing surfaces 79 thereof to bear against a dovetailed forward end surface 80 of the sliding lower chair bracket 68. This serves to mechanically urge the sliding chair bracket in a rearward or upstream direction, locking it in a closed position.

Slideably mounted on the sliding lower chair bracket 68 is the lower mill shoe adapter block 58. The adapter block 58 is guided by a longitudinal key 81 on the slideable chair bracket 68, and a corresponding longitudinal slot 82 in the adapter block, for limited longitudinal movement. At its upstream or forward end, the adapter block has an upwardly facing, transversely disposed dovetailed surface 83, arranged for cooperation with a similar, downwardly facing dovetailed surface 84 on the fixed chair cross bar 73.

A short cam lever 85 is secured to the slideable chair bracket 68 by means of a removable pivot pin 86 and extends upward therefrom, alongside the end face 87 of the adapter block. The cam lever 85 serves to support the pivot pin 57, for the transfer trough 55, as illustrated. Additionally, at is upper end, the cam lever 85 has a downwardly and rearwardly facing dovetailed surface 88 arranged for cooperation with an upwardly and forwardly facing dovetailed surface 89 at the forward end of the lower mill shoe 14. The rearward or upstream end of the mill shoe has a similar upwardly facing dovetailed surface 90, cooperating with a downwardly facing surface 91 on the adapter block. A longitudinal key 92 on the mill shoe 14 (see FIG. 7) cooperates with a longitudinal groove 93 along the top of the adapter block 58 to accommodate limited longitudinal sliding action of the mill shoe.

When the mill shoe, adapter block and lower chair bracket, of the lower mill assembly are in their working positions, as shown in FIGS. 3 and 4, the sliding lower chair bracket 68 is drawn in a rearward or upstream direction by the actuator 71, and eventually by the locking lever 76, until the dovetailed surface 83 of the adapter block abuts against the corresponding surface 84 of the fixed chair bracket. Continued rearward movement of the sliding chair bracket, with the adapter block 58 remaining fixed against the cross bar 73, causes the cam lever 85, which is carried by the sliding chair bracket, to bear against the dovetailed surface 89 of the mill shoe, sliding the mill shoe rearward until the dovetailed surfaces 90, 91 at the rearward or upstream end of the mill shoe are locked. Since the mill shoe is now locked against the adapter block, and the adapter block is in turn locked against the fixed chair bracket, the upper end of the cam lever 85 can no longer move with the continued rearward movement of the sliding chair bracket 68. Accordingly, the cam lever 85 will begin to pivot slightly in a clockwise direction (as viewed in FIGS. 3 and 4) about its pivot pin 86. As this occurs, the lower forward corner 93*a* of the cam lever seats firmly against a forward extension 94 of the sliding chair bracket, locking the lever 85 against continued pivoting movement. Once this occurs, the mill shoe 14, the adapter block 68, the cam lever 85 and the sliding chair bracket 68 are all mechanically interlocked, and will remain in assembled relation by continued rearward force on the sliding chair bracket. Desirably, this is achieved by the locking lever 76, in conjunction with the hydraulic actuator 71.

Pursuant to the invention, when it is time to change the mill shoes 13, 14, the upper adapter block 65, carrying the upper mill shoe 13 is lowered, by mechanisms not shown in FIGS. 1–12, until the upper shoe 13 closely approaches or even touches the lower shoe 14. In some cases, it may not be possible to lower the upper shoe to this extend, without interference with the mill rolls, in which case a filler block (not shown) may be first inserted between the mill shoes, and the upper shoe lowered onto the filler block. In either case, where the upper shoe has been lowered to approximate contact with the lower shoe or filler block, a locking lever 100, which is pivoted at 101 in the upper adapter block, is pivoted in a counterclockwise direction (FIGS. 3 and 4) by an upwardly extending operating rod 102. Cooperating dovetailed surfaces 103, 104 on the locking lever and upper mill shoe respectively are released, which also releases a similar dovetailed interlock at the upstream end of the mill shoe, and allows the upper mill shoe to drop out of its adapter block 65 and be supported entirely on the lower mill shoe. Thereafter, the mechanical locking mechanism 74–79 is released and the fluid actuator 71 is energized to advance the sliding chair bracket 68 in a downstream direction. This sliding action of the chair bracket has two consequences: First, by releasing pressure between the cross bar 73 and the adapter block 58, the cam lever 85 is released, taking clamping and locking pressure off the lower mill shoe 14. The adapter block 58 can now slide in an upstream direction, relative to the sliding chair bracket 68 sufficiently to completely release the upper mill shoe 14. Secondly, the cooperating slideway between the fixed and sliding lower chair brackets 67, 68 is sufficient to allow the sliding lower chair bracket 68 to be extended a substantial distance in the downstream direction (see FIG. 8) such that the mill shoes, both upper and lower, are now exposed and accessible in the downstream side of the mill rolls. In that position, the mill shoes are both manually accessible for manipulation and also accessible to an overhead hoist for removal and replacement.

Figure 8:
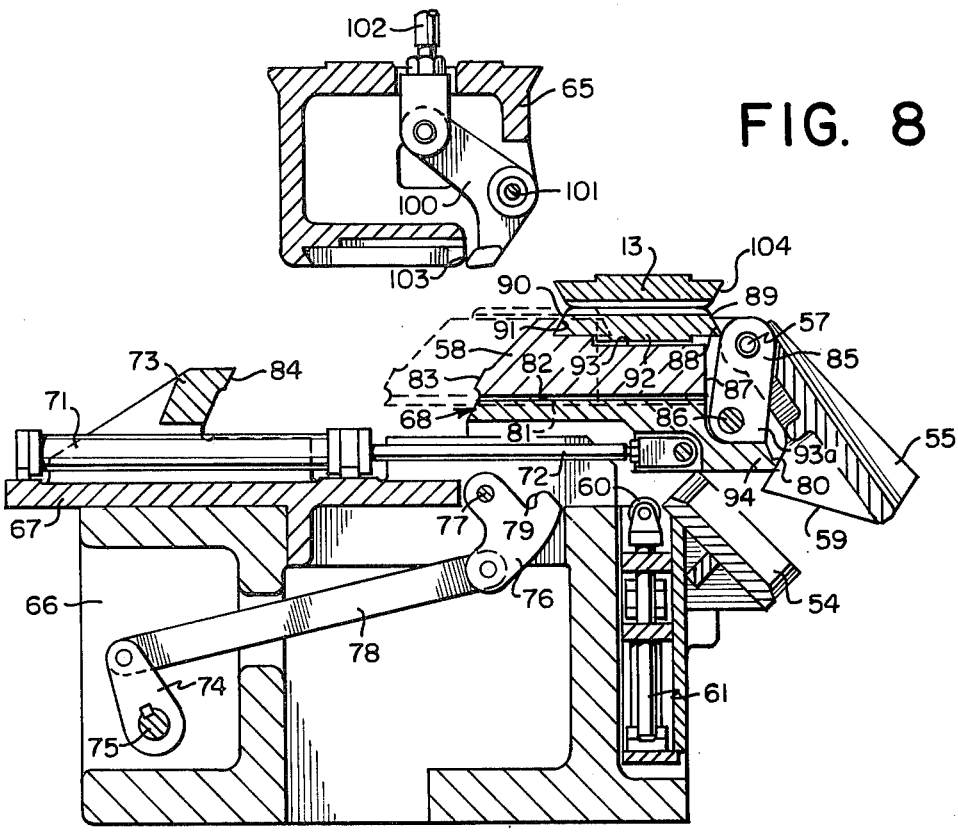
FIG. 8 is a fragmentary cross sectional view, similar to that of FIG. 3, illustrating the mechanism in position for effecting a change of mill shoes.

In conjunction with the outward sliding movement of the movable chair bracket, the lifting cylinder 62 is partially actuated, lifting the pivotable transfer trough 55 sufficiently to clear the intermediate guide trough section 54. After the transfer trough clears the intermediate trough section, it will drop down by gravity, as indicated in FIG. 8. On the return stroke of the actuator 71, the transfer trough will simply cam itself over the intermediate trough section 54 and return to its normal position, as shown in FIG. 3.

To enable removal of the lower mill shoe, the adapter block 58 must be shifted slightly to the left (see FIG. 8) in order to clear the dovetailed surfaces 88–91.

Figure 13:
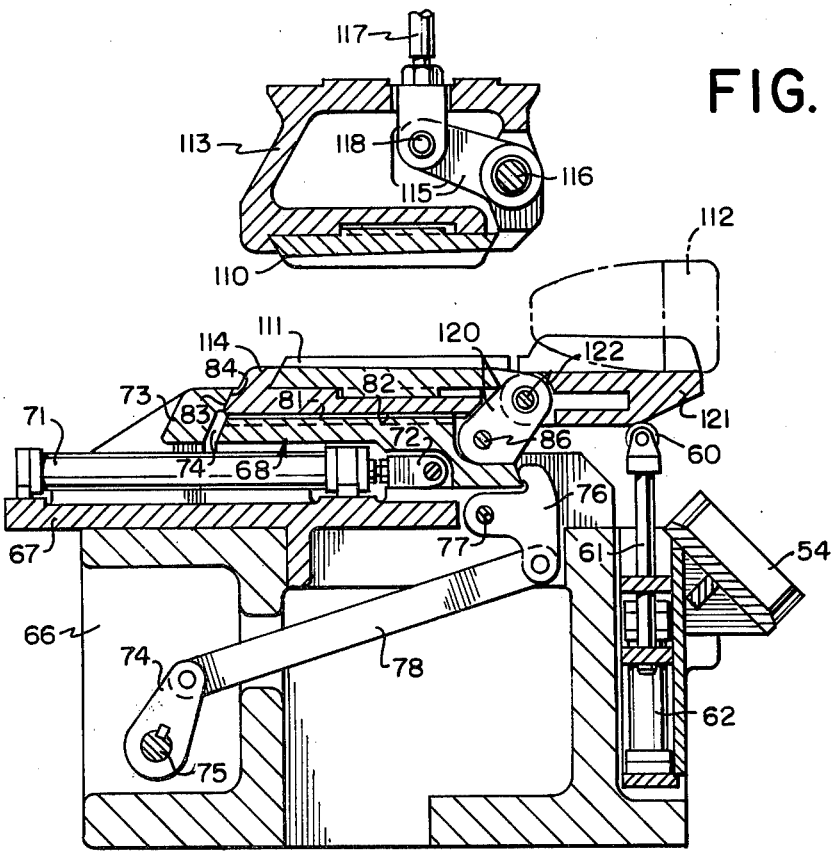
FIG. 13 is a cross sectional view, similar to FIG. 3, illustrating the piercing mill arrangement of FIGS. 1–12, as modified to incorporate a different size of mill shoe and mill shoe adapter, for processing of a larger size of tubing.

In order to accommodate a mandrel plug of a different size, as when changing the size of workpiece to be processed in the mill, it is necessary to change not only the mill shoes, but also the adapter block therefor. Additionally, in the case of the lower mechanism, it is necessary also to change the pivoting transfer trough. With reference now particularly to FIG. 13, upper and lower mill shoes 110, 111 are provided having contours corresponding to a larger size piercing plug 112, as might be used in a second stage piercing operation, for example. Because the larger mill shoes 110, 111 will be separated a greater distance than the mill shoes illustrated in FIGS. 1–12, The upper and lower adapter blocks 113, 114 of reduced height are also employed. The upper adapter block 113 is generally similar to the previously described adapter block 65, incorporates a self-contained locking lever 115 pivoted on a pin 116. When the upper adapter blocks are changed, the operation rod 102 is disconnected from the locking lever, by removal of a pin 118, which normally secures the operating rod to the locking lever. When a new adapter block is secured in position, the new locking lever is secured to the rod by reinserting the pin 118, enabling the new upper mill shoe 110 to be locked in place at the desired time, by retraction of the operation rod 102.

As reflected in FIG. 13, the new lower adapter block 114, being of different height than the previous adapter block 58, necessitates different geometry for the cam lever and the transfer trough. Accordingly, as part of the changeover, a new cam lever 120 is secured in place on the sliding chair bracket 68, by means of the movable pin 86. Carried with the new cam lever 120 is a new transfer trough 121, secured by a pivot pin 122. The function and operation of the new cam lever 120 and transfer trough 121 are the same as described with reference to FIGS. 1–12, as will be understood.

Figure 14:
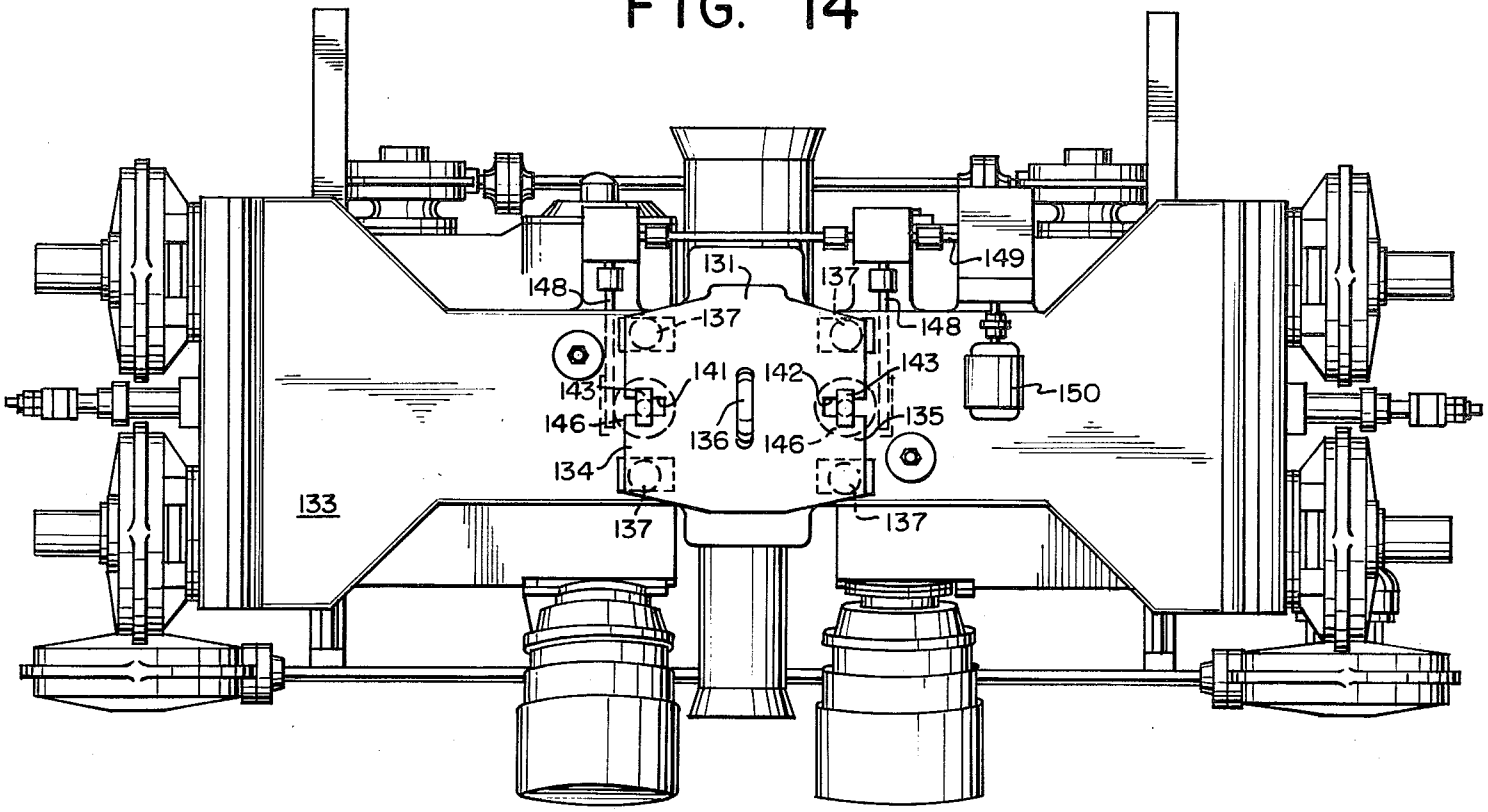
FIG. 14 is a top plan view of a piercing mill as in FIGS. 1–13, illustrating an improved arrangement for expediting removal of the upper chair and its mounting cap, for change of the upper adapter block and/or chair bracket.
Figure 15:
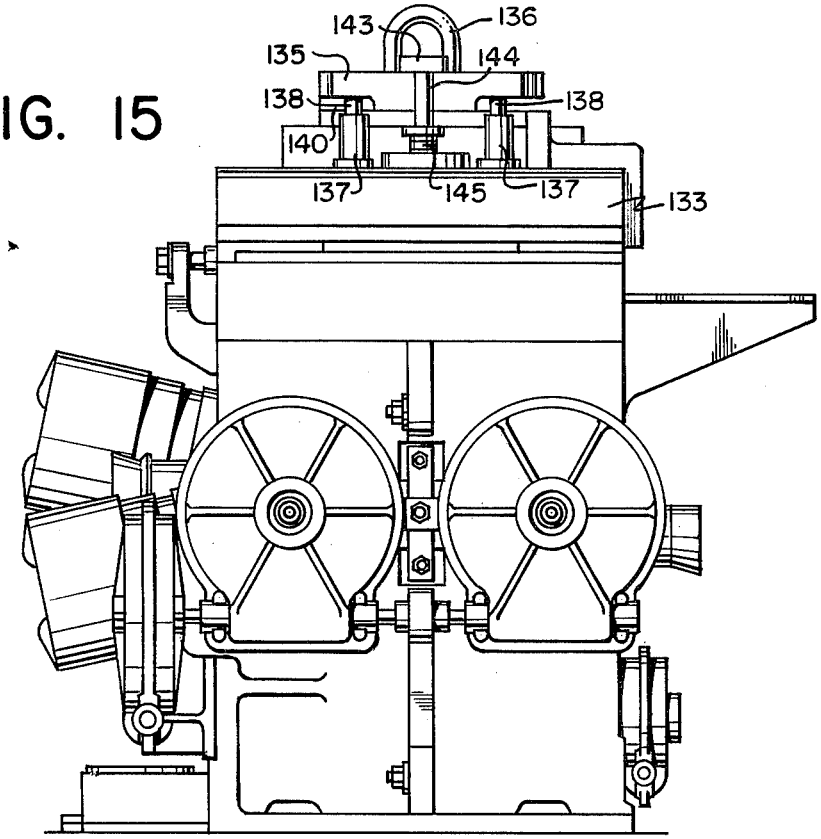
FIG. 15 is a side elevational view of the mill of FIG. 14.
Figure 16:
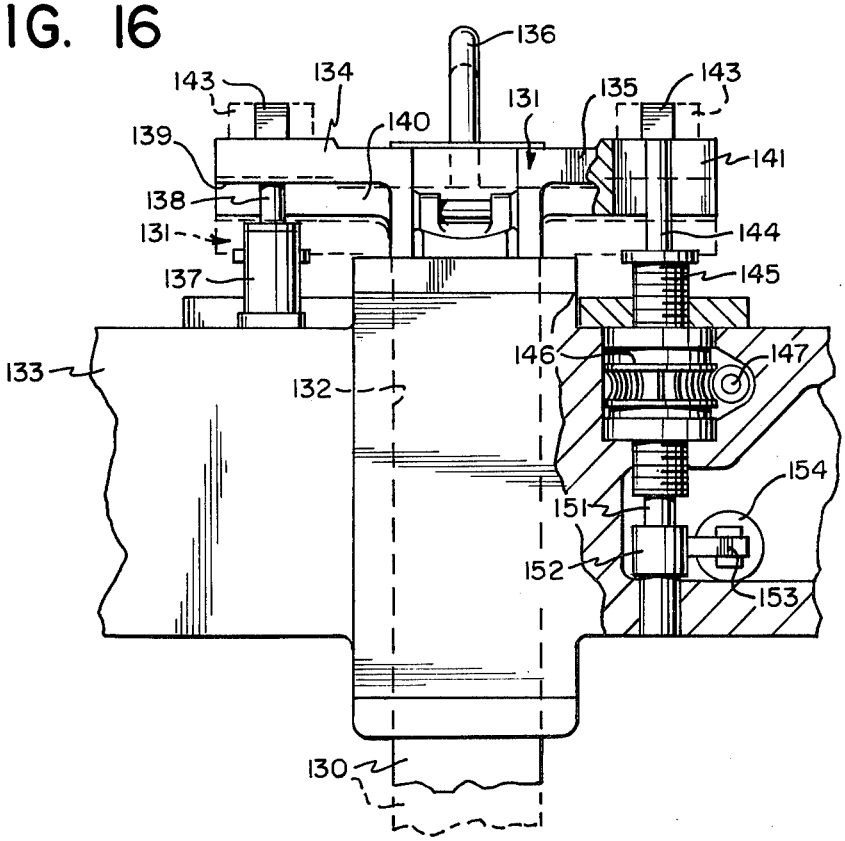
FIG. 16 is an enlarged, fragmentary view, illustrating details of the mill cap and upper chair mounting means, with parts broken away to show details of the hold-down means.

With reference now to FIGS. 14–16, there is illustrated an improved arrangement for securing of the upper chair and its mounting cap, to facilitate replacement from time to time of the adapter blocks and also replacement of the upper chair bracket itself, which may be necessary in some instances. In this respect, it will be understood that, while the mill shoes are frequently replaceable as a function of wear, the adapter blocks are less frequently replaced as a function of new sizes of workpieces, and the upper chair bracket itself may require occasional replacement, because a single bracket may not accommodate the entire range of sizes of adapter blocks. The upper chair bracket 130 is carried by a mounting cap 131, which is slideably received in a center opening 132 in the primary mill cap 133 of the piercing mill. In this respect, the arrangement is generally conventional. Pursuant to the invention, however, improved arrangements are provided for adjustably securing the mounting cap 131, such that its complete removal from, and replacement in, the mill cap may be effected in a highly expeditious manner.

As reflected in FIG. 14, the mounting cap 131 may be of generally rectangular configuration and is formed to provide laterally extending flanges 134, 135. In the center of the cap, typically, is a heavy lifting ring 136 by which the entire assembly may be removed vertically by an overhead hoist.

Mounted on the mill cap 133, adjacent and underneath the corner areas of the chair mounting cap 131, are four lifting cylinders 137. The operating rods 138 of the several lifting cylinders extend upward and are engageable with bottom surface areas 139 of recesses 140 provided in the corner areas of the chair mounting camp. The lifting cylinders 137 serve to support the weight of the chair mounting cap, and are retractable in a downward direction to accommodate lowering of the cap to the position shown in broken lines in FIG. 16.

Pursuant to the invention, the opposite sides of the chair mounting cap 131 are provided with rectangular slots 141, 142 which are arranged to closely receive the transversely aligned upper ends 143 of Tee-headed hold-down rods 144. The hold-down rods 144 are rigidly secured to the upper ends of threaded sections 145, which are guided for vertical movement in the mill cap 133 and are threadedly engaged with internally threaded, rotatable worm wheels 146. The worm wheels 146 are engaged by worm gears 147, and these are in turn driven by shafts 148 (FIG. 14) from a common drive shaft 149 and drive motor 150.

Keyed or otherwise slideably engaged with a lower end extension 151 of the threaded hold-down is an orientation bracket 152 having an actuating lever 153 connected to a fluid actuator 154 or other device capable of manipulating the lever 153 through an arc of 90°. The actuator 154 and lever 153 serve to lock the threaded hold-down rods against rotation, but are movable through a limited arc between locking and release positions. In the locking position, the upper ends 143 of the Tee-headed hold-downs are crosswise to the slots 141 and limit upward movement of the chair mounting cap. In the release position, the Tee-headed hold-downs are rotated 90°, with their upper ends in alignment with the slots 141, enabling the chair mounting cap 131 to be lifted out of the mill cap by the lifting ring 136.

With the mechanism of FIGS. 14–16, when the chair mounting cap 131 is received in the mill cap, it may be adjustably positioned, vertically, to the precise height desired for the particular mill shoe being used, by operation of the adjusting motor 150 to raise or lower the threaded hold-downs 144. The several hydraulic cylinders 137 serve to support the entire weight of the cap 131 and its related parts and to press the cap firmly upward against the restraint of the cross-disposed Tee-headed hold-downs. When it is desired to remove the chair mounting cap, fluid pressure is initially released from the cylinders 137, relieving pressure against the heads 143 of the hold-downs and permitting the heads to be rotated 90°, into alignment with the slots 141, by energizing of the respective actuators 154. The cap may then be engaged by its lifting ring 136 and simply withdrawn vertically out of the mill cap, for effecting the desired change of parts. The arrangement is quick and simple, and greatly expedites the operations involved in removing and replacing the chair mounting cap.

One of the operational advantages of the described hold-down arrangement is the elimination of backlash. Thus, because the cap is at all times urged upward against the T-headed hold-downs, under fluid pressure in the cylinders 137, there is no backlash in the cap mounting system, which might otherwise cause an increased degree of shock loading of the structure.

Referring now to FIGS. 17–23, there is shown an improved arrangement for effecting mandrel plug change in a typical reeling mill. In the reeling mill, like the piercing mill, the working rolls (not shown) are horizontally opposed, on opposite sides of the pass line and serve to both rotate and advance the tubular workpiece, which is guided by longitudinally grooved mill shoes 160, 161 (see FIG. 19). On the downstream side of the mill bight, there is provided a plug changer mechanism, generally designated by the numeral 162, which contains a circulating supply of mandrel plugs 163 arranged sequentially to be positioned at the roll bight.

Typically, the rate of operation of the reeling mill is such, in comparison to that of the piercing mill or the plug mill, that an operating cycle, including the plug change sequence may be carried out in a somewhat greater cycle time, without interferring with mill efficiency. In addition, the operation of the reeling mill is such that the plugs do not require water cooling after use. Accordingly, the plug retaining magazine for the reeling mill may suitably in the form of a horizontally slideable tray-like structure 164 contain a plurality (four in the illustration) of plug-receiving pockets 165 arranged in side-by-side relation. The plug magazine includes a base 166, which is mounted and guided for transverse sliding movement on a stationary guide way structure 167, which extends for a distance on both sides of the working pocket position 168, directly below the pass line 169. A rack 170 is secured to the magazine base 166 and is drivingly engaged by a pinion 171 driven controllably by a motor 172. By appropriate energization of the motor 172 in one direction or the other, the magazine 164 may be selectively positioned with any of its plug-receiving pockets 165 in the working position 168, as will be understood.

Typically and advantageously, the magazine pockets 165 are supported on a frame structure 173, to lie at an upwardly inclined angle of around 45°. The individual pockets 165 are welded or otherwise secured to this frame structure, and are shaped to form a shallow, V-shaped cross section, as indicated in FIG. 23, such that a mandrel plug 163 of any size will automatically be supported in the center of the magazine pocket.

Figures 17, 21:
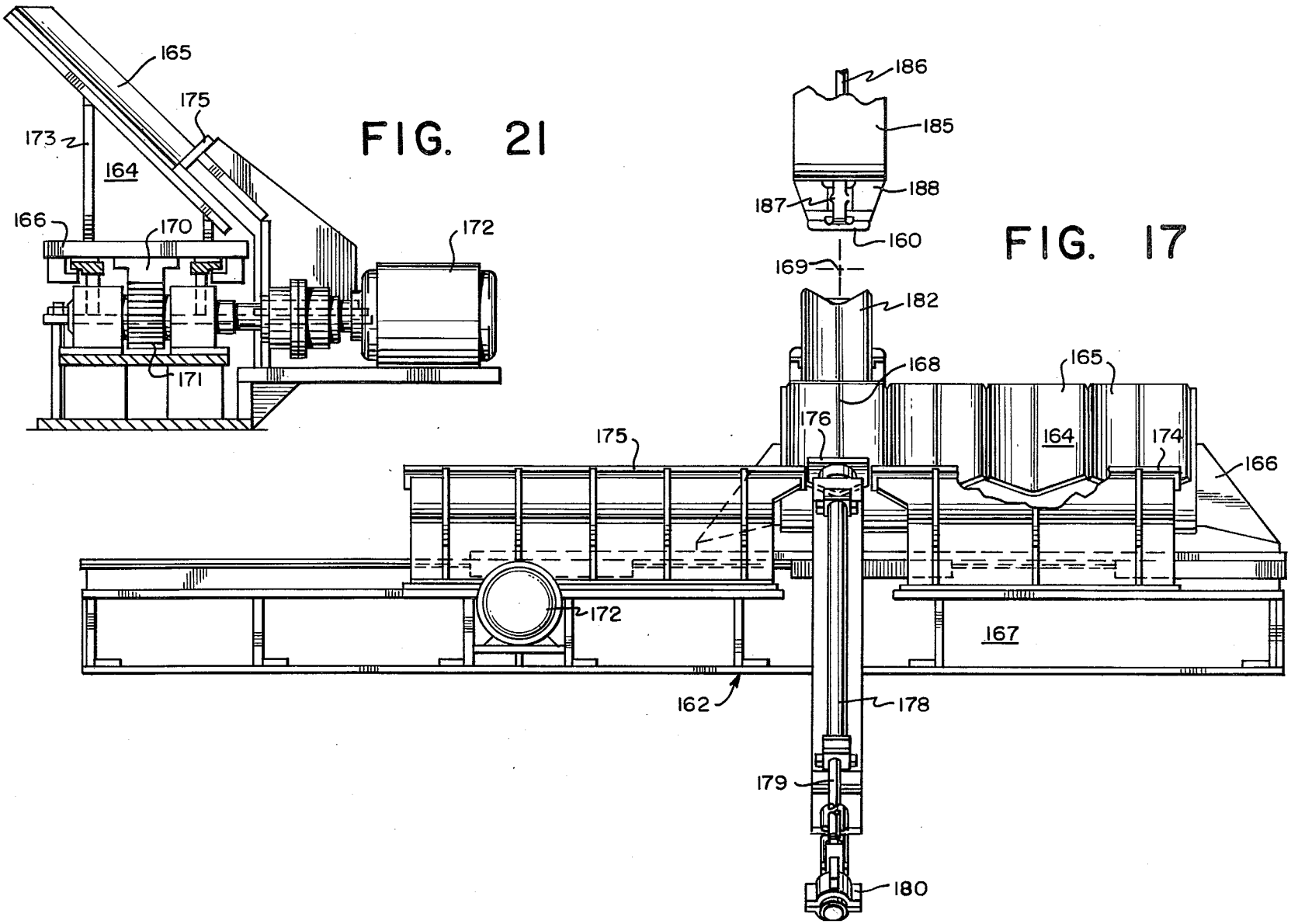
FIG. 17 is an end elevational view of a mandrel plug magazine and loading arrangement adapted particularly for use in conjunction with a reeling mill.
FIG. 21 is a fragmentary cross sectional view as taken generally on line 21—21 of FIG. 18.

In the illustrated apparatus, the lower ends of the magazine pockets 165 are closed by fixed back wall plates 174, 175 extending for a distance on either side of the working position 168. Between the respective backing plates 174, 175 is a pusher abutment plate 176 which is fixedly secured to the upper end of a slideable ram 177. The ram 177 is operated by a fluid actuator 178, the rod element 179 of which is secured to the ram by means of a clamp 180 (FIG. 17). When the ram 177 is fully retracted, the front face of the abutment plate 176 lies substantially flush with the upwardly facing surfaces of the backing plates 174, 175 and forms, in effect, a continuation of the backing plates. Accordingly, the plug magazine 174 may be shifted laterally on the slideway structure 167, to bring any of several loaded magazine pockets 165 into the working position.

Figures 19, 20, 23:
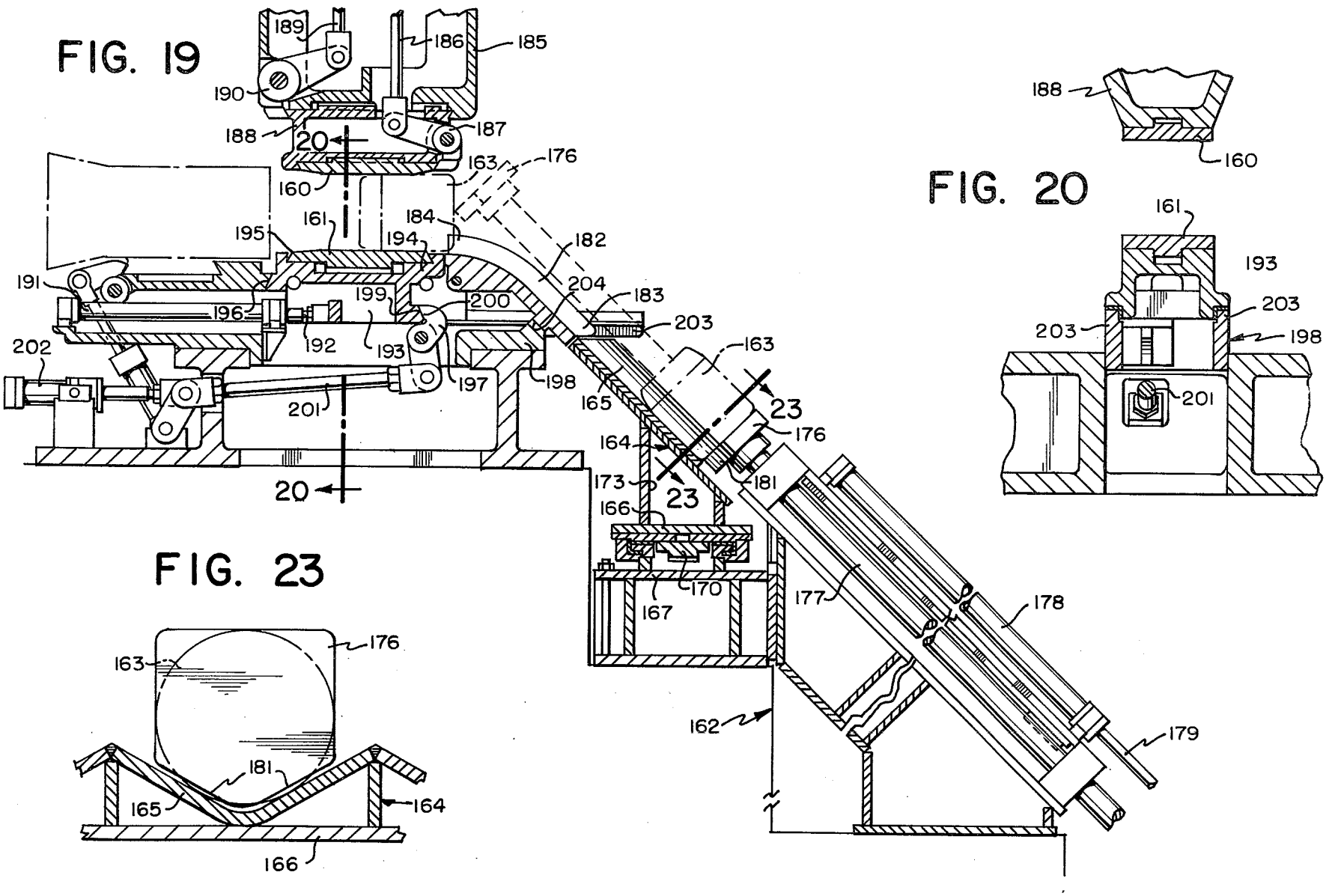
FIGS. 19 and 20 are cross sectional views as taken generally on lines 19—19, 20—20 of FIGS. 18 and 19 respectively.
FIG. 23 is a fragmentary cross sectional view as taken generally on line 23—23 of FIG. 19.

As reflected in FIG. 23, the lower edges 181 of the abutment plate are contoured to conform, with a slight clearance, to the plug supporting surfaces of the magazine pockets 165. Thus, when a magazine pocket is located in the working position 168, the ram 177 may be extended upwardly, moving the abutment plate 176 upward along the pocket 165, to elevate a mandrel plug 163 which is supported therein.

As reflected particularly in FIG. 19, the mill structure includes a curved transfer trough 182, the lower end 183 of which is aligned with and has the same general cross sectional configuration as a magazine pocket 165 in the working position. At its upper end 184, the transfer trough curves around from its approximately 45° incline to an approximately horizontal disposition, generally aligned with the lower mill shoe 161 of the reeling mill. As reflected particularly in FIG. 19, when the ram 177 is extended upwardly, to elevate a mandrel plug 163, the plug is pushed along an upward incline formed by the magazine pocket 165 and by the lower portion of the transfer trough 182. As the plug approaches the upper portion 184 of the transfer trough, it follows the curved contours thereof and assumes a generally horizontal position. The abutment plate 176, continuing to advance in a straight line along the upwardly inclined axis, tends to slide upwardly along the back surface of the mandrel plug, pushing the plug horizontally into the mill bite. Thereafter, when the ram 177 is retracted, the elevated mandrel plug remains in position between the mill shoes, ready for the return in the upstream direction of the mandrel (not shown). When the mandrel is brought into position supporting the plug, the next workpiece may be received in the mill.

At the end of the reeling operation, the tubular workpiece is driven past the mandrel plug and entirely on to the mandrel. The mandrel is then withdrawn in a downstream direction, first stripping off the just-used mandrel plug and then being withdrawn from the interior of the processed workpiece. In the plug stripping stage, the plug may be first withdrawn slightly from the roll bight, so that the stripped-off plug simply falls by gravity down the inclined chute formed by the transfer trough 182, and back into the magazine pocket 165 from which it was originally elevated. The entire plug magazine then shifts laterally to bring a new pocket, with a fresh mandrel plug, into the working position 168 for a subsequent plug loading sequence.

In the reeling mill arrangement illustrated in FIGS. 17–23, changing of the mill shoes 160, 161 can be effected in a manner similar to that described with respect to the piercing mill of FIGS. 1–16. To this end, the upper chair bracket 185 may be lowered, to bring the upper mill shoe 160 down substantially to the lower mill shoe 161, or perhaps onto a filler block inserted between the shoes. The upper shoe can than be released by downward movement of an operating rod 186 to release a locking lever 187 which forms one end of a dovetailed locking arrangement as previously described. Where it is desired to remove not only the upper mill shoe 160, but also its adapter block 188, the latter may be released by means of an operating rod 189 to open a locking lever 190 serving as one end of a dovetailed locking arrangement for the adapter block.

With the upper mill shoe and/or adapter block resting on the lower mill shoe, the assembly may be projected in a downstream direction, to an accessible position behind the mill rolls, by means of a fluid actuator 191, the operating rod 192 of which is removably connected to a lower adapter block 193 which supports the lower mill shoe 161. In the illustrated arrangement, the lower mill shoe is held in position in the lower adapter block by a one-ended dovetail locking arrangement, which provides a dovetailed interlock 194 at the downstream end of the mill shoe and adapter block. At the upstream end 195 the mill shoe is retained in place simply by the action of gravity.

As reflected in FIG. 19, the lower adapter block 193 is locked in working position by cooperating dovetailed surfaces 196, at the upstream end of the adapter, and by a pivoted locking lever 197, which is supported on the lower chair bracket 198 and has a downwardly facing dovetailed surface 199 cooperating with a corresponding upwardly facing dovetailed surface 200 on the adapter block. The locking lever 197 is actuated through a line 201, by a fluid actuator 202. After the adapter block has been drawn to its retracted position, as shown in FIG. 19, the locking lever 197 is pivoted in a counterclockwise direction, so that the adapter block is mechanically secured in position.

Figures 18, 22:
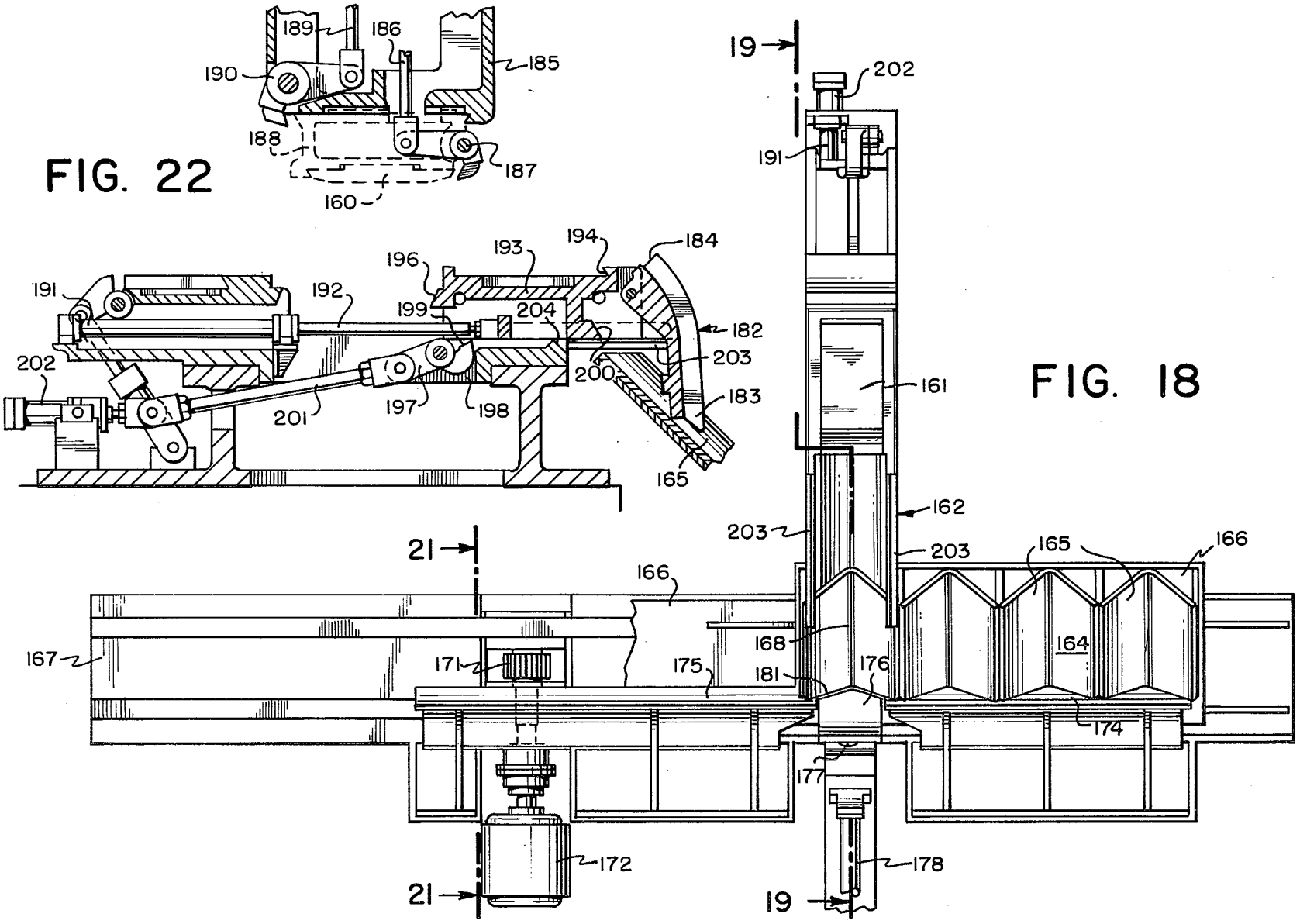
FIG. 18 is a top plan view of the magazine and plug changer arrangement of FIG. 17.
FIG. 22 is a cross sectional view, similar to FIG. 19, illustrating the parts of the mechanism in an extended position as for accommodating a change of mill shoes.

When removing the mill shoes, after lowering the upper mill shoe into supported position on the lower shoe, the locking lever 197 is opened (pivoted clockwise) and the actuator 191 is extended, enabling the lower adapter block 193 to advance along guide tracks 203 to an accessible position on the downstream side of the mill rolls (see FIG. 22). Prior to displacement of the lower adapter block, the plug magazine 164 is moved to the left (as viewed in FIGS. 17, 18) to a position in which the magazine is entirely offset from the working position. This enables the pivoted transfer trough 182, normally supported by a boss 204 on the lower chair bracket, to pivot downward, in order to clear other parts of the mill mechanism (not shown). When the adapter block 193 is retracted back into its working position, the transfer trough 182 simply pivots back into its normal position, supported on the boss 204.

As in the case of the previously described piercing mill, the arrangements provided for handling of the mill shoes greatly expedites the shoe changing procedure, by quickly bringing both shoes, in a released condition, out into an open, accessible position, where the shoes may be manipulated manually and easily lifted off by an overhead hoist.

In any of its forms, the apparatus of the invention serves significantly to expedite and reduce the time cycle of the necessary but non-productive operations of piercing and reeling mills.

For effecting change of mandrel plugs, for example, a mechanically simplified form of plug magazine and feeder is installed on the downstream side of the mill rolls, in position to feed successive ones of a circulating supply of mandrel plugs upward out of the magazine pocket, on to a transfer trough and into position on the pass line of the mill, to be picked up by the mill mandrel. In the case of the piercing mill, where the operating cycles are rapidly completed, the plug changing portion of the cycle must be rapidly accomplished. This, in conjunction with the general need for water cooling of the used mandrel plugs, suggest the desirability of a drum type of plug magazine. For the reeling mill, which normally runs at half the overall rate of speed of the piercing mill (there being two reeling mills to support the operations of a single piercing mill) the somewhat reduced cycle times and the ability to air cool of the mandrel plugs, enables a horizontal rack style of plug magazine to be utilized effectively.

In one form of the new plug feeding mechanism, an abutment plate and ram arrangement serves to elevate a mandrel plug onto a transfer trough which, while initially at an angle, is pivoted upward, to carry the mandrel plug from its originally inclined axis up to substantial alignment with the pass line of the mill. After the mandrel plug has been picked up by the mandrel and is in working position in the mill, the transfer trough may be retracted back to its inclined position, to serve as a chute for the reception of the mandrel plug at the end of the working cycle.

In another advantageous form of the invention, the transfer trough is of arcuate configuration, so as to guide the elevating mandrel plug from an inclined axis on to a horizontal axis. The range of extension of the plug elevating ram is such that the ram continues to push obliquely on the mandrel plug as it approaches a horizontal orientation, pushing it sufficiently in toward the mill bight that the mandrel plug does not tend to return back down the transfer trough, when the ram is retracted.

The equipment of the invention also incorporates significant improvements in the area of mounting the mill shoes and adapters, such that down time of the mills is maintained at a practical minimum when changing these components, as is necessary from time to time. Of particular significance, means are provided for dropping of an upper mill shoe onto the lower shoe and then projecting the lower shoe horizontally out of the mill bight, into an exposed position which is not only easily accessible to an overhead hoist, but is also manually accessible to the mill operator.

In conjunction with the improved arrangement for mounting of the mill shoes, the equipment utilizes a novel arrangement for securing the mill shoe adapters, whereby the motions required in moving the mill shoe horizontally into an accessible position serve to effect release of the series of mechanical interlocks, enabling easy removal not only of the mill shoe but of the adapter block which supports the mill shoe.

The apparatus of the invention also incorporates an advantageous arrangement for adjustably mounting the cap structure which supports the upper chair bracket. This arrangement includes a plurality of upwardly acting fluid cylinders, to carry the entire weight of the chair mounting cap, in conjunction with mechanically adjustable Tee-headed hold-down rods. The hold-down rods are rotatable through a small arc, sufficient to orient the Tee-headed upper ends in either aligned or crosswise relation to receiving slots. When the Tee-headed hold-downs are crosswise to the slots, the mounting cap is locked in position, held up against the hold-downs by the fluid cylinders and precisely adjusted as to its vertical position by screw adjustment of the hold-downs. Release and removal of the mounting cap may be quickly accomplished by rotation of the Tee-headed hold-downs into alignment with their respective slots and thereafter lifting out the chair mounting cap.

In addition to providing for quick removal and replacement of the cap, the utilization of hold-downs in combination with opposed fluid cylinders serves to maintain the system free of backlash, providing improved operational characteristics.

All of the foregoing features of the invention are directed to achieving significant reduction in the non-productive cycles and operations involved in the running of piercing and reeling mills. The several expedients provided by the invention enable a substantially greater precentage of mill time to be occupied with actually processing of the tubular workpieces, so that the overall production efficiency of the mills is enhanced.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A plug changer mechanism for a piercing or reeling mill or the like having horizontally opposed working rolls and upper and lower workpiece guide structures, which comprise a. a plug magazine mounted on the discharge side of said working rolls and below the pass line of the mill, b. said plug magazine having a plurality of plug pockets therein and being controllably indexable to bring said successive pockets into a predetermined working position below said pass line, c. said plug pockets, when in said working position being disposed on a sufficiently steep incline to accommodate return by gravity of a used plug, d. inclined guide trough means leading from said working position toward the pass line of the mill on the discharge side of said working rolls, e. said guide trough means including a removable transfer trough section adapted for discharge with said lower guide structure to accommodate mandrel plugs of different diameter, f. a plug pusher ram aligned with the plug pocket in said working position and controllably operable to elevate a plug along said guide trough, g said pusher ram having an abutment plate which, when the ram is retracted, effectively forms part of the magazine pocket at said working position.

2. A plug changer mechanism according to claim 1, further characterized by a. said transfer trough being removably pivotally connected to said lower workpiece guide structure.

3. A plug changer mechanism according to claim 2, further characterized by a. the pivoted transfer trough being supported in stationary manner during plug changing operations and being pivotable to accommodate removal and exchange of said lower guide structure.

4. A plug changer mechanism according to claim 3, further characterized by a. said transfer trough section having a steeply inclined lower portion aligned with the magazine pocket at the working position, an arcuate intermediate portion, and a generally horizontal upper portion, b. said plug pusher ram being extendable linearly along said steeply inclined portion to and beyond the level of said generally horizontal upper portion, whereby to push a plug upward along said inclined portion and then onto said horizontal portion.

5. A plug changer mechanism according to claim 2, further characterized by a. actuator means engageable with said pivotable transfer trough and operative to pivot said trough from a steeply inclined position to a generally horizontal position.

6. A plug changer mechanism according to claim 5, further characterized by a. said actuator means comprising a fluid actuator mounted below said transfer trough and engageable therewith upon upward extension of the actuator, b. said transfer trough being removable with said lower guide structure independently of said fluid actuator.

7. A plug changer mechanism according to claim 2, further characterized by a. a linear slideway structure mounted below and transversely of said pass line, b. said magazine comprising a linear pocket-forming structure slideably mounted on said slideway structure and controllably indexable to bring successive pockets into said working position.

8. A plug changer mechanism according to claim 2, further characterized by a. said magazine comprising a rotary drum structure mounted for rotation about a generally horizontal axes, b. said drum having a plurality of radially disposed pockets inclined at a steep angle to the axis of rotation, c. means mounting said drum with its axis of rotation directly below said pass line, whereby the uppermost pocket of said drum is in said working position and is steeply inclined toward said pass line.

9. In a piercing or reeling mill or the like of the type having horizontally opposed working rolls and upper and lower workpiece guide structures including mill shoes and mill shoe adapters, an improved arrangement of the workpiece guide structures, which comprises a. a horizontally movable member mounting the lower mill shoe, b. means for releasably receiving the upper mill shoe, whereby said upper shoe may be released and caused to be supported on said lower shoe, and c. means for moving said movable member longitudinally to move said lower mill shoe, along with an upper shoe supported thereby, to an accessible position displaced from the working rolls.

10. A mill according to claim 9, further characterized by a. said horizontally movable member comprises a lower chair bracket, b. a lower mill shoe adapter mounted on said bracket and carrying said lower mill shoe, and c. means operative upon retracting movement of said chair bracket, along with said lower adapter and lower mill shoe, to mechanically interlock said adapter and mill shoe in working position.

11. A mill according to claim 10, further characterized by a. a fixed chair bracket slideably supporting said movable chair bracket for horizontal movement, b. said fixed chair bracket having an abutment surface engageable with a cooperating surface at one end of said adapter for lockingly positioning said one end of the adapter with reference to the fixed chair bracket, c. said adapter and lower mill shoe having cooperating abutment surfaces at said one end for lockingly positioning said one end of the mill shoe with reference to the adapter, d. locking means on said movable chair bracket, having an abutment surface cooperating with an abutment at the opposite end of said lower mill shoe, operative upon retracting movement of said movable bracket to lockingly secure said lower mill shoe and adapter in position.

12. A mill according to claim 11, further characterized by a. said locking means comprising a cam lever pivotally secured at its lower end to said movable chair bracket and having an abutment surface at its upper end engageable with the lower mill shoe, b. said cam lever being pivotable through a limited angle and being rigidly locked against pivoting movement when lockingly engaged with said mill shoe.

13. A mill according to claim 12, further characterized by a. removable pivot means connecting said cam lever to said movable chair bracket, whereby said cam lever may be replaced by a similar lever of different dimensions when changing to a different size of lower adapter.

14. A mill according to claim 13, further characterized by a. said mill including a plug change mechanism below the pass line of the mill and on the side thereof toward which said movable chair bracket is movable to carry the mill shoes into accessible position, b. said plug changer mechanism including a plug magazine, a pusher, and a guide trough leading from the plug magazine toward the pass line, and c. a transfer trough section forming part of said guide trough and pivotally secured to the upper end of said cam lever.

15. A mill according to claim 14, further characterized by a. said transfer trough being normally supported in stationary manner.

16. A mill according to claim 14, further characterized by a. means for upwardly pivoting said transfer trough to elevate a plug toward said pass line.

17. A mill according to claim 9, further characterized by a. said horizontally movable member comprises a lower shoe adapter for said mill, b. a fixed chair bracket on said mill supporting said adapter, c. cooperating abutment surfaces on said bracket and on one end of said adapter for lockingly positioning said one end of the adapter with reference to the bracket, d. the lower mill shoe being supported on said adapter, e. cooperating abutment surfaces on the opposite end of said adapter and said mill shoe for lockingly positioning said mill shoe, and f. locking means engaging the opposite end of said adapter for lockingly positioning the adapter with reference to the chair bracket.

18. In a piercing or reeling mill or the like of the type having horizontally opposed working rolls and upper and lower workpiece guide structures, spaced side frames and a mill cap structure connecting said side frames, an improved upper workpiece guide structure, which comprises a. an upper chair bracket forming part of said upper guide structure, b. a chair mounting cap secured to and supporting said upper chair bracket, c. said chair mounting cap having a flanged portion positioned above the mill cap and having a portion extending downward through and slideably guided by said mill cap, d. a plurality of adjustable hold-down members mounted on the mill cap and releasably engageable with said chair mounting cap for adjustably limiting upward movement of the mounting cap in relation to the mill cap, e. means for urging said mounting cap upwardly against said adjustable hold-down members, and f. controllable means for releasing said hold-down members from said mounting cap to accommodate bodily withdrawal of said mounting cap and chair bracket from said mill cap.

19. A mill according to claim 18, further characterized by a. said adjustable hold-down members comprising Tee-headed rods, b. said flanged portion having slot-like openings therein for the reception of said rods, permitting free passage of the rods in one rotational orientation thereof and lockingly engaging the rods in a second rotational orientation thereof.

20. A mill according to claim 19, further characterized by a. said controllable releasing means comprising actuator means connected to said Tee-headed rods for controlling the rotational orientation thereof.

21. A mill according to claim 18, further characterized by a. said urging means comprising means for yieldably urging said flanged portion upward against said hold-down members.

22. A mill according to claim 21, further characterized by a. said urging means comprises a plurality of fluid actuators mounted on one of said mill cap or mounting cap and operative when extended to tend to separate one cap from the other.

23. A mill according to claim 20, further characterized by a. threaded members connected to said Tee-headed rods and guided for vertical movement in said mill cap, b. said threaded members being normally held against rotation by said controllable releasing means, and c. controllably rotatable threaded collars mounted by said mill cap and engaging said threaded members for adjusting the vertical position thereof.

* * * * *